US006964167B2

(12) United States Patent
Abel et al.

(10) Patent No.: US 6,964,167 B2
(45) Date of Patent: Nov. 15, 2005

(54) METHOD FOR OPERATING A STEAM POWER INSTALLATION AND CORRESPONDING STEAM POWER INSTALLATION

(75) Inventors: Tilman Abel, Nürnberg (DE); Dieter Blanck, Erlangen (DE); Georg Haberberger, Bubenreuth (DE); Imke Riebeck, Spardorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/661,191

(22) Filed: Sep. 12, 2003

(65) Prior Publication Data

US 2004/0105518 A1 Jun. 3, 2004

Related U.S. Application Data

(63) Continuation of application No. PCT/EP02/02023, filed on Feb. 25, 2002.

(30) Foreign Application Priority Data

Mar. 15, 2001 (EP) ..... 01106600

(51) Int. Cl.[7] ..... F01K 7/34
(52) U.S. Cl. ..... 60/653; 60/676; 60/679
(58) Field of Search ..... 60/653, 676, 679

(56) References Cited

U.S. PATENT DOCUMENTS 3,969,891 A * 7/1976 Aguet ..... 60/39.182
4,373,340 A * 2/1983 Keller ..... 60/677
4,465,027 A * 8/1984 Steinegger ..... 122/406.4
4,841,722 A * 6/1989 Bjorge ..... 60/39.182
5,045,272 A 9/1991 Lyman et al.
6,233,939 B1 * 5/2001 Ngo-Beelmann et al. ..... 60/653

FOREIGN PATENT DOCUMENTS

| | | |
|---|---|---|
| DE | 482635 C | 5/1928 |
| DE | 1811008 A | 4/1970 |
| DE | 2164631 A | 7/1973 |
| EP | A2-1055801 | 11/2000 |
| FR | 1396379 A | 2/1964 |
| FR | 2551181 A | 3/1985 |

OTHER PUBLICATIONS

Von G. Falgenhauer—Beitragsmöglichkeiten der Speisewasser–, Kondensatund Anzapfdampfströme zur schnellen Leistungsänderung fossil befeurter Kraftwerksblöcke—VGB Kraftwerstechnik 60—Heft 1—Jan. 1980—XP000670759.

* cited by examiner

*Primary Examiner*—Hoang Nguyen

(57) ABSTRACT

The invention relates to a method for operating a steam power installation, whereby steam produced in a boiler is condensed in a condenser after passing through at least one turbine, and the condensate obtained is preheated and redirected back to the boiler as boiler feed-water. In order to preheat the condensate, said condensate is split into a first partial current and a second partial current. Only the first partial current is preheated and the second partial current is then mixed with the preheated first partial current. The power of the turbine can thus be increased as required, up to the boiler reserve of the steam power installation.

20 Claims, 1 Drawing Sheet

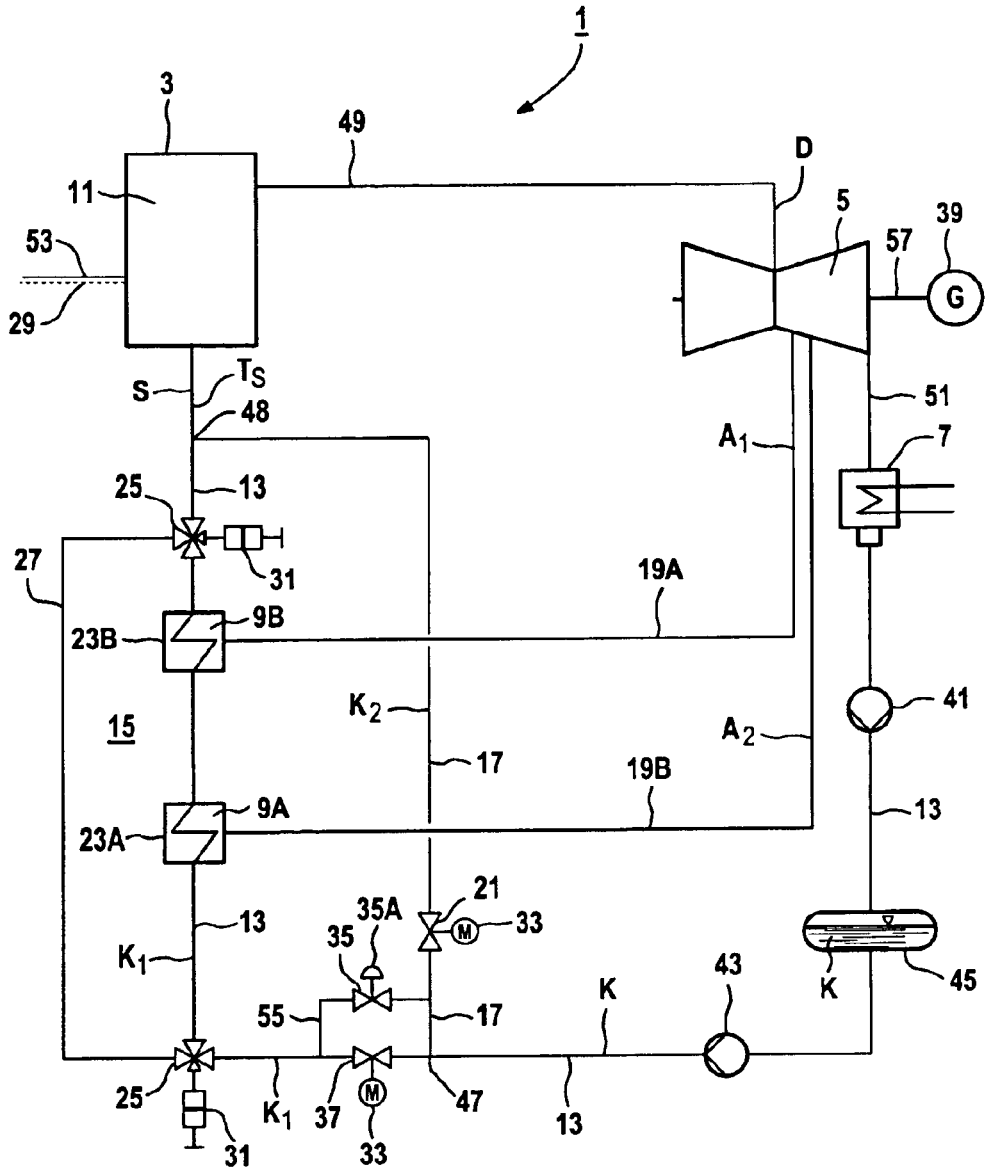
1
3
49
D
11
5
39
53
57
G
29
S
$T_S$
48
51
$A_1$
7
25
13
27
31
19A
23B
9B
15
$K_2$
41
$A_2$
17
19B
9A
13
23A
21
35A
33
13
$K_1$
35
43
K
K
45
55
17
25
$K_1$
37
47
13
31
33

METHOD FOR OPERATING A STEAM POWER INSTALLATION AND CORRESPONDING STEAM POWER INSTALLATION

CROSS REFERENCE TO APPLICATIONS

This application is the continuation of International Application No. PCT1EP02/02023, filed Feb. 25, 2002 and claims the benefit thereof. The International Application claims the benefits of European application No. 01106600.8 EP, filed Mar. 15, 2001, both of the applications are incorporated by reference herein in their entirety.

FIELD OF THE INVENTION

The invention relates to a method for operating a steam power installation, whereby steam generated in a boiler is condensed in a condenser after flowing through at least one turbine, and the condensate obtained is preheated and fed back to the boiler as feed-water. The invention also relates to a steam power installation for implementing the method.

BACKGROUND OF THE INVENTION

A steam power installation is normally used for generating electrical power or for driving a machine. It involves a working medium, usually a water-water/steam mixture, which is fed through a steam-generating circuit of the steam power installation, being converted into steam in an evaporator or steam generator (boiler). The steam that is generated expands to produce work in a steam turbine and is then fed to a condenser. The working medium condensed in the condenser is then fed via a pump to the boiler again for generating steam.

In a generally known steam power plant of this type, the condensate used as feed-water is successively preheated to close to the boiling temperature by means of partial steam mass flows from the turbine steam volume, thereby increasing the thermodynamic efficiency of the whole process. By removing the steam from the turbine steam volume, however, the subsequent steam turbine stages can extract less power from the steam fluid.

A method for operating a steam power plant is known from EP-A2-1 055 801, in which the condensate used as feed-water is successively preheated to close to the boiling temperature by means of partial steam mass flows from the turbine steam volume.

In order to avoid the reduction in power extraction in the subsequent steam-turbine stages, it is provided that the heat emitted from fuel cells is used to preheat the condensate. Preheating the feed-water from the heat emitted from the fuel cells, and the associated increase in the amount involved in the expansion, achieves an increase in the steam process efficiency. The fuel-cell arrangement incorporated in the preheating line of EP-A2-1 055 801 is a relatively complex and costly way of achieving preheating by the external supply of heat via the fuel cells.

SUMMARY OF INVENTION

The object of the invention is to define a method of the type cited in the introduction, in which preheating of the boiler feed-water to be fed to the boiler is achievable while simultaneously increasing the power of the turbine. A further object of the invention is to specify a steam power installation that can be used to implement such an operating method.

This object is achieved according to the invention by a method for operating a steam power installation, in which steam generated in a boiler is condensed in a condenser after flowing through at least one turbine, and the condensate obtained is preheated and fed back to the boiler as feed-water, the condensate being divided for condensate preheating into a first partial flow and a second partial flow, only the first partial flow being preheated, and the second partial flow being re-mixed with the preheated first partial flow.

The invention is also based on the consideration that to increase the efficiency of a turbine connected in a steam power installation, not only does the steam mass flow through the turbine need to be taken into account, but also the preheat temperature of the boiler feed-water fed to the boiler. Both process parameters are coupled together by the bleeding of the turbine commonly performed in steam power installations, whereby a partial steam mass flow is removed from the steam turbine process to preheat the condensate obtained. This steam removal is at the expense of the turbine power, in particular of the overall efficiency of the steam power installation. In the known installations, the condensate obtained in the condenser is completely preheated using bleeder steam, being preheated to as high a temperature as possible close to the boiling temperature before being fed to the boiler as boiler feed-water. This rigid coupling between the condensate preheating and the steam removal means that the turbine power is fixed for constant live steam pressure.

A completely different way is now demonstrated by the invention, in which, if necessary, an increase in the turbine power of a steam power installation is achieved by flexible setting of the preheat temperature according to demand by means of mixing partial flows of condensate. To do this, the condensate is divided into a first partial flow and a second partial flow, only the first partial flow being preheated, and the second partial flow being re-mixed with the preheated first partial flow. The term partial flow is intended here as a true partial flow of the condensate condensed in the condenser. By mixing the first, preheated condensate flow with the second, non-preheated condensate flow, one is able to obtain, compared with preheating the whole condensate, a mixture temperature that is lower than the temperature of the preheated first partial flow of condensate prior to mixing with the second partial flow. Flexible setting of the mixture temperature is advantageously possible by adjusting the partial flows.

Of particular advantage is the fact that by preheating only a partial flow, a smaller amount of heat is required to preheat the first partial flow compared with preheating the complete condensate in the known installations. Thus process heat in the form of a higher steam mass flow through the turbine is available to increase the turbine power. The method provides, for the first time, the possibility of increasing the turbine power according to demand, frequently if necessary, up to the boiler reserve (not seconds reserves) of a steam power installation by partial and selective bypassing of the preheating by the second partial flow of condensate, without needing to raise the live steam pressure above the design value.

The division into the fist partial flow and the second partial flow can advantageously be flexibly set according to the power demand, so that correspondingly more or less process steam is available in the turbine to do work.

Also of advantage is the fact that, using the solution presented, it becomes possible for the first time to achieve an increase in power without limiting the lifetime of the components, in particular the preheating devices of the steam turbine installation, as a result of only part of the steam flowing through the preheating line. In particular, heat consumption is also clearly more efficient than when the preheating line is completely bypassed when, for at least some of the time, absolutely no condensate is preheated, i.e. the first partial flow equals 0. This is important, for example for high-pressure pre-heaters or the like.

In a particularly advantageous embodiment, the first partial flow is preheated using bleeder steam from the turbine. Using bleeder steam from the turbine to preheat only the first partial flow ensures that only a correspondingly smaller amount of bleeder steam is required for preheating compared with traditional bleeding. Thus more process steam in the steam turbine is directly available for increasing the turbine power. It is also advantageous if the condensate mass flow of the first partial flow is directly correlated to the bleeder-steam mass flow, so that the greater the first partial flow, the larger the amount of bleeder steam required to preheat the first partial flow to a desired temperature. By suitable coupling of the bleeder-steam flow to the first partial flow, the bleeder-steam requirement regulates itself automatically. This self-regulation effect makes the method a particularly cost-effective and flexible means of operating the steam power installation, in particular of increasing the turbine power.

In a preferred embodiment, the first partial flow is preheated in at least two stages. By preheating the first partial flow of condensate in more than one stage, it is possible to precisely set a desired temperature of the first partial flow after preheating. According to demand, all pre-heater stages or just a part of the pre-heater stages can be provided for preheating the first partial flow. In this way one advantageously has the option of utilizing to capacity individual preheating stages, and thus having additional process heat available for the turbine process. The precise setting of a desired temperature of the first partial flow after preheating and prior to mixing with the second partial flow, also enables the mixture temperature of the partial flows to be set precisely, so that the preheat temperature of the boiler feed-water can be set equally precisely. In an alternative embodiment, preheating of the first partial leg is also possible in just one stage, in particular precisely one stage.

Preferably, a preheat temperature of the boiler feed-water of 210° C. to 250° C., in particular 220° C. to 240° C., is set for the mixing of the partial flows. The pressure of the boiler feed-water then typically equals about 300 bar. By mixing with the second, non-preheated partial flow, the preheat temperature of the boiler feed-water is reduced by about 30° C. to 70° C. compared with the temperature of the preheated first partial flow.

In a preferred embodiment, the first partial flow and the second partial flow are divided in the ratio 0.4 to 0.8, in particular in the ratio 0.6 to 0.7. For example, in a typical operating mode of the steam power installation according to the method of the invention, the condensate obtained in the condenser is divided such that the first partial flow of condensate equals about 60% and the second partial flow of condensate about 40%. In this case, the first partial flow is preheated from a temperature of about 200° C. to a temperature of about 280° C., while the second partial flow is not preheated and continues at a temperature of 200° C. up to the mixing with the first partial flow. The pressure of the condensate flows remains substantially constant throughout at about 300 bar.

Advantageously, the preheat temperature of the feed-water to be fed to the boiler can be set according to demand by proportioning the amount of the second partial flow bypassing the preheating line, and mixing the two partial flows after preheating the first partial flow, where the division of the partial flows is preferably controlled or regulated.

In addition, after the mixing of the partial flows, the mixture is preferably fed as boiler feed-water to a fossil-fired steam generator. The method of the invention is intended in particular for use in steam power installations having a boiler that is fired with a fossil fuel, for instance coal or oil.

The object, directed at a steam power installation, is achieved according to the invention by a steam power installation for implementing the method described above, comprising a boiler for generating steam, at least one turbine, a condenser connected on the steam outlet side of the turbine, a condensate line for feeding the condensate back to the boiler, and a preheating device connected in the condensate line for preheating condensate, where a bypass line bypassing the preheating device is provided so that the preheating device only receives a first partial flow of the condensate.

Providing a bypass line that bypasses the preheating device ensures that the preheating device only receives the first partial flow of condensate, while a second partial flow flows through the bypass line without preheating. Bypass line is here understood to mean that it is taken parallel to the preheating device, the bypass line branching off from the condensate line upstream of the preheating device, and being reconnected to the condensate line downstream of the preheating device. A branching point is provided upstream of the preheating device for this purpose, while a mixing point is positioned downstream of the preheating device. The condensate from the condenser can be divided at the branching point into the first partial flow and a second partial flow complementary to this with respect to the whole condensate flow. After the branching point, viewed from the direction of flow of the condensate, the first condensate flow is fed along the condensate line in which the preheating device for preheating the condensate is connected. The second condensate flow and the preheated first condensate flow can be mixed at the mixing point, i.e. at the downstream-located connection point of bypass line to condensate line, whereby a mixture temperature can be set according to the mass flow of the first and the second partial flow of condensate, and according to the heat absorption of the first condensate flow in the preheating device.

In a particularly preferred embodiment, the preheating device is connected to the turbine via a bleeder line, achieving a direct coupling between bleeder steam as preheating medium in the heat exchange and the first partial flow of condensate in the preheating device of the steam power installation. The thermal energy needed for preheating can be set directly via the bleeder-steam mass flow, the bleeder-steam mass flow varying under self regulation according to the level of the mass flow of the first partial flow. The greater the first partial flow, the greater the heat requirement in the preheating device, and hence also the amount of bleeder steam removed from the turbine.

The bypass line preferably has a control valve for regulating a second partial flow of the condensate that bypasses the preheating device. The control valve is used to regulate or perhaps to preset the second partial flow, which does not flow through the preheating device and thus does not lead to a removal of bleeder steam. The second partial flow can be precisely set by the control valve in the bypass line, and hence also the amount of heat required for preheating in the preheating device the second partial flow complementary to the first partial flow. In addition, the mixture temperature that is established in the condensate line when the partial flows mix at the mixing point, can advantageously be regulated by the control valve. By this means, the amount of the second partial flow bypassing the preheating device in the bypass line can be set, in particular it can be regulated in a suitable control circuit, according to the level of demand for increased power from the steam turbine.

The bypass line preferably flows into the condensate line downstream of the preheating device, this inflow point also being the mixing point at which the first partial flow is mixed with the second partial flow, whereby after the mixing a desired preheat temperature of the boiler feed-water to be fed to the boiler establishes itself automatically.

The preheating device preferably has at least one heat exchanger, in particular a high-pressure preheater. A plurality of heat exchangers can also be connected one after the other, enabling multi-stage heating of the first partial flow of condensate. In the embodiment of the heat exchanger as a high-pressure preheater in a steam power installation, the preheater receives condensate at a pressure of about 300 bar, and is assigned to a high-pressure stage of the turbine. The turbine can, however, also have a high-pressure partial turbine and/or a medium-pressure partial turbine and/or a low-pressure partial turbine, as is usually provided in steam power installations.

The system design of the invention can consequently be applied very flexibly to different steam power installations comprising a combination of different turbine types (high-pressure, medium-pressure, low-pressure turbines) having corresponding preheating devices.

A diversion line that can be activated by a quick-shutoff fitting is preferably connected in parallel with the preheating device. This diversion line is provided to divert the condensate completely around the preheating device in the quick-shutoff situation, for instance in an emergency situation where there is the risk of flooding or overheating of the preheating device. In the quick-shutoff situation, the diversion line can be activated, i.e. switched open, by the quick-shutoff fitting, simultaneously interrupting the flow of condensate in the condensate line to the preheating device. For this purpose, the quick-shutoff fitting is designed, for example, as a three-way fitting, which directs at least the first partial flow of condensate via the diversion line after it is activated, so that preheating of condensate no longer takes place in the preheating device. In the normal situation, the diversion line is not activated, so that the first partial flow is fed to the preheating device via the condensate line. Advantageously, using the diversion line that can be activated via the quick-shutoff fitting achieves increased operational reliability of the steam power installation, in particular in combination with the bypass line according to the invention.

Further advantages of the steam power installation follow analogously to the advantages of the operating method of the steam power installation described above.

BRIEF DESCRIPTION OF THE DRAWINGS

The single FIGURE is a schematic diagram showing an exemplary steam power installation.

DETAILED DESCRIPTION OF INVENTION

The method according to the invention and a steam power installation for implementing the method are described with reference to an exemplary embodiment and a schematic diagram, in which the single FIGURE shows in simplified form a steam power installation. The steam power installation 1 shown in the FIGURE, which is part of a power plant, has a steam turbine 5 and a boiler 3 for generating steam D. A condenser 7 is connected to the steam outlet side of the turbine 5 via a bleeder line 51. In order to feed condensate K back to the boiler 3, the steam power installation 1 has a condensate line 13 that is connected to the outlet side of the condenser 7. A first pump 41, a feed-water container 45 and a second pump 43 are connected one after the other in the condensate line 13 in the direction of flow of the condensate. In addition, a preheating device 15 for preheating condensate K is connected in the condensate line 13, positioned in front of the boiler 3 in the direction of flow of the condensate K. The preheating device comprises a first preheating stage 9A and a second preheating stage 9B connected to the outlet of the first preheating stage. The preheating stages 9A, 9B are here designed as heat exchangers 23A, 23B respectively. The boiler 3 has a fossil-fired steam generator 11, which comprises a fuel supply 53 for supplying a fossil fuel 29, for example coal or oil. A bleeder line 19A leads from one stage of the steam turbine 5 to the heat exchanger 23B. A bleeder line 19B leads from a further stage of the turbine 5 to the heat exchanger 23A. A respective amount of bleeder steam $A_1$, $A_2$ can be fed via the bleeder lines 19A, 19B to the preheating device 15, or more precisely to the heat exchangers 23A, 23B for preheating condensate K.

A bypass line 17 bypasses the preheating device 15, the bypass line branching off from the condensate line 13 at a separation point 47, bypassing the preheating device 15 and feeding back into the condensate line 13 at a mixing point 48 downstream of the preheating device 15. A control valve 21 is provided in the bypass line 17 for regulating a partial flow $K_2$, subsequently referred to as second partial flow $K_2$, that bypasses the preheating device 15. The control valve 21 has a motor actuator 33, via which the desired valve setting of the control valve 21 and hence the first partial flow $K_1$ can be set. The condensate K delivered via the second pump 43 out of the feed-water container 45 can hereby be divided into a first partial flow $K_1$ and a second partial flow $K_2$ at the separation point 47, the first partial flow $K_1$ being supplied to the preheating device 15 via the condensate line 13, and the second partial flow $K_2$ bypassing the preheating device 15 via the bypass line 17, so that the preheating device 15 only receives the first partial flow $K_1$ of condensate K.

A sliding valve 37, which can be adjusted via a motor actuator 33, and in normal operation is open, is connected in the direction of flow of the condensate K after the separation point 47 in the condensate line 13. Connected in parallel with the sliding valve 37 is a branch line 55, which is connected from the bypass line 17 to the condensate line 13 and has a low-load control valve 35 having an actuator element 35A. The control valve 35 is closed in normal operation, so that no condensate K gets through via the branch line 55. The low-load control valve 35 is only provided for the low-load situation, when the sliding valve 37 is closed, and, by means of the actuator element 35A of the control valve 35, a small amount of condensate K commensurate with the load demand reaches the preheating device 15 via the branch line 55.

In addition, a diversion line 27, which can be activated via a quick-shutoff fitting 25, is connected in parallel with the preheating device 15, a quick-shutoff fitting 25 being connected to the condensate line 13 upstream and downstream of the preheating device 15 respectively. The quick-shutoff fitting 25 can be switched quickly between two settings via an actuator 31. The fitting 25 is designed as a three-way fitting for this purpose, the diversion line 27 being closed, i.e. not activated, in the normal operating state. Condensate K then flows in a first partial flow $K_1$ through the preheating device 15 and in a second partial flow $K_2$ via the bypass line 17. In a quick-shutoff situation, the quick-shutoff fitting 25 is activated via the actuator 31, thereby switching open the diversion line 27 and cutting off the condensate flow via the condensate line 13 through the preheating device 15. Hence in the quick-shutoff situation, the preheating device 15 is completely bypassed, i.e. no condensate K is supplied to the preheating device 15 and hence none is heated. The diversion line 27 that can be activated is used for bypassing and hence protecting the preheating device 15, in particular the heating surfaces of the heat exchangers 23A, 23B.

During operation of the steam power installation 1, service steam D generated in the boiler 3 is fed via the steam line 49 to the turbine 5, where it expands to produce work. The turbine 5 is here shown simplified, but can consist of a plurality of partial turbines, not shown in greater detail, for example a high-pressure partial turbine, a medium-pressure partial turbine and a low-pressure partial turbine. The steam D expanded to low pressure is fed via the bleeder line 51 to the condenser 7, and condensed there to condensate K. The condensate K is delivered by means of the first pump 41 via the condensate line 13 into the feed-water container 45 where it is collected. The boiler 3 is fed with preheated condensate K as boiler feed-water S from the feed-water container 45 via the preheating device 15 by means of the second pump 43, so that a closed water-steam circuit is created. The useful work obtained in the turbine 5 is transferred via the rotating shaft 57 to a generator 39 coupled to the shaft 57, and converted into electrical energy.

In order to increase the power of the turbine 5 according to demand, the condensate K is divided into a first partial flow $K_1$ and a second partial flow $K_2$ for condensate preheating, only the first partial flow $K_1$ being preheated and the second partial flow $K_2$ being remixed with the preheated first partial flow $K_1$. This division of the condensate K into the first partial flow $K_1$ and the second partial flow $K_2$ occurs at the separation point 47, the second partial flow $K_2$ bypassing the preheating device 15 via the bypass line 17. The first partial flow $K_1$ is preheated by means of bleeder steam $A_1$, $A_2$ from the turbine 5. The first partial flow $K_1$ is preheated in two stages 9A, 9B to a temperature of about 280° C. at a pressure of 300 bar. The first partial flow $K_1$ is mixed with the second partial flow $K_2$ at the mixing point 48, with a mixture temperature of 210° C. to 250° C., in particular 220° C. to 240° C., being established. The partial flows $K_1$, $K_2$ are divided, for example, such that the first partial flow $K_1$ makes up about 40% of the total condensate flow, and the second partial flow $K_2$ correspondingly about 60% of the total condensate flow before the separation point 47. The division of the partial flows $K_1$, $K_2$ is controlled or regulated here via the control or proportioning valve 21, whose valve position can be set precisely by the motor actuator 33. This results in proportioned bypassing of the preheating device 15 via the bypass line 17, with a correspondingly lower requirement for bleeder steam $A_1$, $A_2$ for preheating the first partial flow $K_1$. As a result of less bleeder steam $A_1$, $A_2$ being removed compared with traditional installation designs by the selective and proportioned bypassing of the preheating device 15, a correspondingly greater mass flow of steam D is available for producing work in the turbine 5. Thus by dividing into two partial flows $K_1$, $K_2$, the possibility of increasing the power according to demand up to the boiler reserve (not seconds reserves) of the steam power installation 1 is achieved, without needing to raise the live steam pressure above the design value. Moreover, the temperature $T_S$ of the boiler feed-water S fed to the boiler 3 can be set precisely and if necessary varied by the mixing of the first partial flow $K_1$ and the second partial flow $K_2$ at the mixing point 48, with, for example, a boiler feed-water temperature $T_S$ of 210° C. to 250° C. at a pressure of 300 bar being provided as required. The removal of bleeder steam $A_1$, $A_2$ from the turbine 5 advantageously occurs here under self-regulation by the coupling of the first partial flow $K_1$ with the bleeder steam $A_1$, $A_2$ via the heat exchangers 23A, 23B. The greater the first partial flow $K_1$ that is set, the greater the removal of bleeder steam $A_1$, $A_2$ for preheating, in order to achieve a desired temperature of the first partial flow $K_1$ after flowing through the preheating device 15. In thermal equilibrium, the temperature of the first partial flow $K_1$ after passing through the heat exchangers 23A, 23B is normally approximately equal to the temperature of the bleeder steam $A_1$, $A_2$, i.e. about 280° C. at a pressure of 300 bar for instance. After mixing the non-preheated second partial flow $K_2$ with the first partial flow $K_1$ at the mixing point 48, the mixture temperature establishes itself automatically according to the division ratios of the partial flows $K_1$, $K_2$ and the temperature levels. This mixture temperature is also the preheat temperature $T_S$ of the boiler feed-water S. The preheat temperature $T_S$ is correspondingly lowered compared with traditional steam power installations, yet an increase in power of the turbine 5 is achieved by the lower heat consumption for preheating the condensate K. In particular, the heat consumption is also clearly more efficient than when the preheating device 15 is totally bypassed, which is the usual way to increase power. Using the design of the invention, it becomes possible, by a partial flow through the preheating device 15, to bring about an increase in the power of the turbine without limiting the lifetime of the components of the preheating device 15, for example the heating surfaces of the heat exchangers 23A, 23B.

What is claimed is:

1. A steam power installation, comprising:

a boiler for generating steam;

at least one turbine;

a condenser connected to the turbine on the steam outlet side of the turbine;

a condensate line for feeding condensate from the condenser to the boiler;

a preheating device connected in the condensate line for preheating the condensate, wherein a bypass line bypassing the preheating device is provided so that the preheating device only receives a first partial flow of the condensate and only the first partial flow is preheated;

a branch line located downstream of the bypass line and connected to the bypass line such that during a low load operation of the turbine an amount of condensate flow is supplied to the preheating device;

a diversion line connected in parallel with the preheating device such that the first partial flow is diverted directly to the boiler when the diversion line is activated and the diversion line is adapted to be activated by a shutoff fitting; and a bleed flow from the turbine supplied to the preheating device such that a power output of the turbine is controlled by the amount of bleed flow from the turbine.

2. The steam power installation as claimed in claim 1, wherein the preheating device is connected to the turbine via a bleeder line.

3. The steam power installation as claimed in claim 1, wherein the bypass line has a control valve for regulating a second partial flow of the condensate that bypasses the preheating device.

4. The steam power installation as claimed in claim 2, wherein the bypass line has a control valve for regulating a second partial flow of the condensate that bypasses the preheating device.

5. The steam power installation as claimed in claim 1, wherein the bypass line flows into the condensate line downstream of the preheating device.

6. The steam power installation as claimed in claim 2, wherein the bypass line flows into the condensate line downstream of the preheating device.

7. The steam power installation as claimed in claim 3, wherein the bypass line flows into the condensate line downstream of the preheating device.

8. The steam power installation as claimed in claim 1, wherein the preheating device has at least one heat exchanger.

9. The steam power installation as claimed in claim 2, wherein the preheating device has at least one heat exchange.

10. The steam power installation as claimed in claim 3, wherein the preheating device has at least one heat exchanger.

11. The steam power installation as claimed in claim 5, wherein the preheating device has at least one heat exchanger.

12. The steam power installation as claimed in claim 8, wherein the heat exchanger is a high-pressure preheater.

13. A method for operating a steam power installation, comprising:

generating a volume of steam in a boiler;

supplying the volume of steam to a turbine;

extracting a first portion of the steam based on a required power output of the turbine and supplying the steam to a preheating unit;

controlling a power output from the turbine by the amount of bleed flow from the turbine supplied to the preheating device;

condensing a remaining second portion of the steam in a condenser after flowing the steam through the turbine;

preheating the condensate steam;

feeding back the condensate steam to the boiler as feed-water;

dividing the condensate into a first partial flow and a second partial flow;

supplying an amount of condensate flow to the preheating unit during low load operation via a branch line located downstream of the bypass line and connected to the bypass;

diverting the first partial flow directly to the boiler through a diversion line connected in parallel with the preheating device and the diversion line is adapted to be activated by a shutoff fitting;

preheating the first partial flow; and mixing the second partial flow with the first partial flow.

14. The method as claimed in claim 13, wherein the first partial flow is preheated with bleeder steam from the turbine.

15. The method as claimed in claim 13, wherein the first partial flow is preheated in at least two stages.

16. The method as claimed in claim 14, wherein the first partial flow is preheated in at least two stages.

17. The method as claimed in claim 13, wherein a preheat temperature of the boiler feed-water of 210° C. to 250° C., in particular 220° C. to 240° C., is set for the mixing of the partial flows.

18. The method as claimed in claim 13, wherein the first partial flow and the second partial flow are divided in the ratio 0.4 to 0.8, in particular in the ratio 0.6 to 0.7.

19. The method as claimed in claim 13, wherein the division of the partial flows is controlled or regulated.

20. The method as claimed in claim 13, wherein after the mixing of the partial flows, the mixture is fed as boiler feed-water to a fossil-fired steam generator.

* * * * *